United States Patent [19]

Dineen

[11] 4,345,437

[45] Aug. 24, 1982

[54] STIRLING ENGINE CONTROL SYSTEM

[75] Inventor: John J. Dineen, Durham, N.H.

[73] Assignee: Mechanical Technology Incorporated, Latham, N.Y.

[21] Appl. No.: 168,076

[22] Filed: Jul. 14, 1980

[51] Int. Cl.[3] ..... F02G 1/04

[52] U.S. Cl. ..... 60/521; 60/520

[58] Field of Search ..... 60/517, 518, 520, 521; 62/6

[56] References Cited

U.S. PATENT DOCUMENTS

| | | |
|---|---|---|
| Re. 27,567 | 1/1973 | Baumgardner et al. . |
| Re. 29,518 | 1/1979 | Franklin . |
| Re. 30,176 | 12/1979 | Beale . |
| 2,127,286 | 8/1938 | Bush . |
| 2,157,229 | 5/1939 | Bush . |
| 2,545,861 | 3/1951 | Sallou . |
| 2,611,236 | 9/1952 | Kohler et al. . |
| 2,992,536 | 7/1961 | Carnahan . |
| 3,296,808 | 1/1967 | Mallock . |
| 3,339,077 | 7/1967 | Shapiro . |
| 3,400,281 | 9/1968 | Malik . |
| 3,434,162 | 3/1969 | Wolfe . |
| 3,478,695 | 11/1969 | Goranson et al. . |
| 3,487,635 | 1/1970 | Prast et al. . |
| 3,525,215 | 8/1970 | Conrad . |
| 3,530,681 | 9/1970 | Dehne . |
| 3,548,589 | 12/1970 | Cooke-Yarborough . |
| 3,559,398 | 2/1971 | Meijer et al. . |
| 3,563,028 | 2/1971 | Goranson et al. . |
| 3,583,155 | 6/1971 | Schuman . |
| 3,597,766 | 8/1971 | Buck . |
| 3,604,821 | 9/1971 | Martini . |
| 3,608,311 | 9/1971 | Roesel, Jr. . |
| 3,645,649 | 2/1972 | Beale . |
| 3,678,686 | 7/1973 | Buck . |
| 3,733,837 | 5/1973 | Lobb . |
| 3,767,325 | 10/1973 | Schuman . |
| 3,782,859 | 1/1974 | Schuman . |
| 3,805,527 | 4/1974 | Cooke-Yarborough et al. . |
| 3,807,904 | 4/1974 | Schuman . |
| 3,822,388 | 7/1974 | Martini et al. . |
| 3,827,675 | 8/1974 | Schuman . |
| 3,828,558 | 7/1974 | Beale . |
| 3,894,911 | 7/1975 | Cooke-Yarborough . |
| 3,899,888 | 8/1975 | Schuman . |
| 3,902,328 | 9/1975 | Claudet . |
| 3,906,739 | 9/1975 | Raimondi . |
| 3,928,974 | 12/1975 | Benson . |
| 3,937,018 | 2/1976 | Beale . |
| 3,949,554 | 4/1976 | Noble et al. . |
| 3,991,586 | 11/1979 | Acord . |
| 4,012,910 | 3/1977 | Schuman . |
| 4,036,018 | 7/1977 | Beale . |
| 4,044,558 | 8/1977 | Benson . |
| 4,058,382 | 11/1977 | Mulder . |
| 4,072,010 | 2/1979 | Schuman . |
| 4,077,216 | 3/1978 | Cooke-Yarborough . |
| 4,132,505 | 1/1979 | Schuman . |
| 4,148,195 | 4/1979 | Gerstmann et al. . |
| 4,183,214 | 1/1980 | Beale et al. . |
| 4,215,548 | 8/1980 | Beremand ..... 60/520 |

FOREIGN PATENT DOCUMENTS

| | | |
|---|---|---|
| 1407682 | 6/1965 | France . |
| 1539034 | 1/1979 | United Kingdom . |

OTHER PUBLICATIONS

AERE-R7693-E. H. Cooke-Yarborough, "Fatigue Characteristics of the Flexing Members of the Harwell Thermomechanical Generator".

Harwell Report AERE-M2437 (Revised), Issued Mar., 1974, E. H. Cooke-Yarborough, "Simplified Expressions for the Power Output of a Lossless Stirling Engine".

Harwell Report AERE-R8036, Issued May, 1975, E. H. Cooke-Yarborough, "Efficient Thermo-Mechanical Generation of Electricity from the Heat of Radioisotopes".

Harwell Report AERE-M2886, Issued Apr. 1977, E. H. Cooke-Yarborough, "A Data Buoy Powered by a Thermo-Mechanical Generator: Results of a Years Operation at Sea".

E. H. Cooke-Yarborough, "Stirling-Cycle Thermo-Mechanical Power Sources for Remote or Inaccessible Communications Sites".

"60-Cycle AC from Sunshine, Solar Stirling Engine, "Popular Science, Jun., 1978, pp. 74-77.

"Thermal Oscillators," 12th TEC, Aug. 30, 1977.

"Free Piston Heat Pumps," 12th IECEC, Aug. 30, 1977.

"Thermal Oscillators," 8th IECEC Meeting on Aug. 14, 1973 at Philadelphia, PA.
Report No. NO1-HV-4-2901-6 in Contract No. NO1-HV-4-2901, granted by the National Heart and Lung Institute to the University of Washington Joint Center of Graduate Studies, Report Date Aug. 1979.
"A Practical Philips Cycle for Low-Temperature Refrigeration", Walter H. Higa, Jul.-Aug. 1965, Cryogenic Technology, pp. 203-208.
"A Small Free-Piston Stirling Refrigerator", 14th IECEC, vol. 1, Aug. 5-10, 1979, A. K. DeJonge.

*Primary Examiner*—Allen M. Ostrager
*Assistant Examiner*—Stephen F. Husar
*Attorney, Agent, or Firm*—Joseph V. Claeys; Arthur N. Trausch, III

[57] ABSTRACT

A free-piston Stirling engine usable as a heat pump has a closed vessel filled with helium working gas which is heated at the bottom end and cooled at the top end. The vessel contains a displacer supported for axial reciprocal oscillation on a gas spring post mounted on the vessel. The displacer shuttles the working gas from end to end in the vessel, alternately heating and cooling the gas. The vessel is sealed with a flexible diaphragm which flexes in response to the pressure wave generated in the vessel as the working gas is alternately heated and cooled. When the diaphragm flexes, it displaces hydraulic fluid in a hydraulic chamber and drives a power piston for driving a linear alternator and a gas compressor. A gas spring operating on a second hydraulic cylinder on the other side of the power piston stores part of the energy of the piston stroke and returns it for the return stroke. Controls are provided for balancing and controlling the hydraulic fluid pressure, for starting the Stirling engine, and for modulating its power output.

10 Claims, 9 Drawing Figures

STIRLING ENGINE CONTROL SYSTEM

BACKGROUND OF THE INVENTION

This invention relates to an improved Stirling engine and in particular to an improved free-piston Stirling engine having a hydraulic coupling to an output member such as a compressor of a heat pump.

The Stirling engine is a closed-cycle engine with cyclic recirculation of the working fluid. Power is produced by compressing the working fluid at a low temperature and expanding it at a high temperature. The required heat is added continually during expansion of the working gas inside the engine through a heat exchanger wall. Since this wall has a high heat capacity, it is not possible to rapidly heat and cool the same wall, therefore, the working gas is alternately shuttled between two stationary variable volume chambers in the working space, held respectively at high and low temperatures and called the hot space and the cold space.

The alternating heating and cooling of the same working gas would inherently waste quantities of heat, so a regenerator is placed between the hot and cold sources in the path of the working gas. Heat is stored in the regenerator as the gas moves from the hot space toward the cold space and is then released to the working gas as it passes back through the regenerator in moving form the cold space to the hot space.

The conventional Stirling engine includes two pistons: one, called the displacer, is a lightweight body mounted on a rod which moves the displacer to shuttle the working gas between the hot and cold spaces; the other, called the power piston, is of heavier construction and is responsible for the work transfer over the cycle.

The motions of the power and displacer pistons can be considered from a first order perspective, to give rise to three pressure wave components, two of which occur within the cold space or engine compression space. The first pressure component, called the power piston pressure wave, is associated with the motion of the power piston. Physically, this is the pressure wave which would exist in the engine if the displacer piston were held fixed and the power piston were oscillated sinusoidally. The amplitude of the power piston pressure wave is related to the springiness of the engine and is primarily a function of the engine pressure, enclosed volume, piston area, and piston mass.

The second component is associated with the motion of the displacer piston and is called the displacer piston pressure wave. Physically, this is the pressure wave which would exist in the compression space volume if the power piston were fixed and the displacer piston were oscillated sinusoidally. This wave is the result of two generally conflicting effects: the first is the change in pressure which results from moving the displacer rod in and out of the engine volume; the second is the change in pressure which occurs due to the change in gas temperature as the working fluid is shuttled between the hot and cold spaces in the engine. As the displacer moves toward the engine hot space, the first effect tends to increase the pressure and the second effect tends to decrease the pressure. For any practical engine operating point, the temperature effect more than offsets the volume effect. As a consequence, the displacer pressure wave leads the displacer motion by 180°.

The third component of the pressure wave occurs in the expansion space volume or the hot space and is due to seal leakage. This component results from the pressure drop across the seal and is proportional to the pressure amplitude, leading the pressure by 90°. It is inimical to good engine efficiency and is the subject of considerable development effort to minimize. The sum of these three components is the pressure wave in the working space; if there were no pressure drop in the heat exchanger duct, this wave would lead the power piston motion.

The pressure wave components in the expansion and compression spaces may further be broken down into two elements: first, the basic pressure wave and, second, the pressure drop due to flow through the heat exchanger duct. The basic pressure wave approximates the pressure wave which would be measured in the middle of the heat exchanger duct. The expansion space pressure is the basic pressure plus the pressure drop between the middle of the heat exchanger duct and the expansion space. The compression space pressure is found in a similar manner. The forces which are exerted on the power piston and the displacer, because of the basic pressure wave, are obtained by multiplying the magnitude of this pressure wave by the area of the power piston face and the displacer rod area, respectively. These forces, which are 180° out-of-phase with the pressure wave, are in a ratio of approximately 10:1. The power is proportional to the component of the force phasor which is normal to the displacement vector. As a consequence of the displacer rod area, the engine does feed power into the displacer through the rod area, and if the rod area is large enough, this power will exceed the power dissipated through the heat exchangers. The lag angle between the engine pressure wave and the power piston phasor is referred to as the engine pressure angle. A low pressure angle corresponds to a peaked or springy PV diagram while a high pressure angle corresponds to a more oval or flat PV diagram. From a thermodynamic perspective, a flat PV diagram is more desirable than a peaked PV diagram since the flat diagram has a lower peak-to-peak pressure ratio and hence, a smaller temperature variation of the gas in the compression and expansion space volume, and therefore, lower thermal mixing and thermal energy losses. The thermal mixing loss is the irreversibility which occurs when gas from the heater or cooler enters the expansion or compression space volume at a temperature significantly different from the gas temperature within the volume. The thermal entry loss is the loss which occurs when gas from the expansion or compression space enters the heater or cooler at a temperature significantly different from the heater or cooler metal temperature.

The unique feature of free-piston Stirling engines is that the piston motions are determined by the state of a balanced dynamic system of springs and masses, rather than a mechanical system.

The free-piston Stirling engine is an ideal vehicle to power residential-sized heat exchangers. It is extremely quiet, indeed virtually silent, in operation. It can be designed to be heated by any fuel whatsoever, and therefore is able to utilize the cheapest and most available fuel at any particular time. By using the same fuel for both heating and cooling, the seasonal demand on particular power sources can be substantially leveled to the benefit of the distribution system. The free-piston Stirling engine is sealed so the working fluids within the pressure vessel are not subject to loss through the shaft seals of conventional mechanical output Stirling engines. However, in a closed hermetic system utilizing more than one working fluid, it is necessary that they be separated. In addition, the lubrication within the sealed vessel must be maintained at the correct pressure and properly separated from the other working fluids, particularly the engine working fluid.

Power modulation of a Stirling engine heat pump alternator is theoretically controllable by controlling the pressure of the working gas in the engine. However, this also has the effect of altering the engine frequency which in turn can alter the frequency of the electric output of the system. In some situations, it may be desirable to regulate the power output while maintaining the system frequency constant.

As the power requirements for the heat pump increase in hot or cold weather, this condition must be sensed by the system which must automatically adjust the operating parameters to produce a higher output power. The conventional technique for accomplishing the power modulation is to adjust the time interval in which the compressor operates. This is inherently inefficient because of start-up power surges and the other known inefficiencies in operating a high-power output device intermittently to produce low power output levels. A much more efficient method would be to run a system continuously but modulate the input energy to produce a controlled output power as desired.

SUMMARY OF THE INVENTION

It is an object of this invention to provide a free-piston Stirling engine having a displacer sprung to ground and a hermetic separation of the engine working fluid and the power piston. The engine is coupled to a gas compressor having a P-V diagram rotated 90° to the engine P-V diagram, so an energy storage mass is incorporated in the compressor to absorb energy from the engine during the high power output portion of its cycle, and to deliver that stored energy to the compressor during the high power demand portion of its cycle.

A power diaphragm is provided to seal the working gas in the working space, and a hydraulic coupling between the power diaphragm and the power piston provides a uniform backing for the diaphragm and a means for selecting the stroke of the power piston. The displacer is supported for axial oscillation on a post fixed relative to the vessel and incorporates a gas spring between the post and the displacer. A midstroke porting arrangement is provided to maintain the equality of the gas spring and working gas mean pressures. A control is provided for continuously modulating the engine power in response to system demands.

It is a further object of the present invention to provide means for modulating the working gas pressure to control the engine output power.

It is a further object of the present invention to provide controls for balancing the hydraulic fluid pressure and for starting the Stirling engine.

DESCRIPTION OF THE DRAWINGS

The invention and its many objects and advantages will become more clear upon reading the following description of the preferred embodiment in conjunction with the following drawings, wherein:

FIG. 5A is a combined temperature-entropy graph of the engine and the compressor of the embodiment shown in FIG. 1;

FIG. 5B is a combined pressure volume diagram of the engine working gas and the compression spaces in the compressor;

DESCRIPTION OF THE PREFERRED EMBODIMENT

Figure 1A:
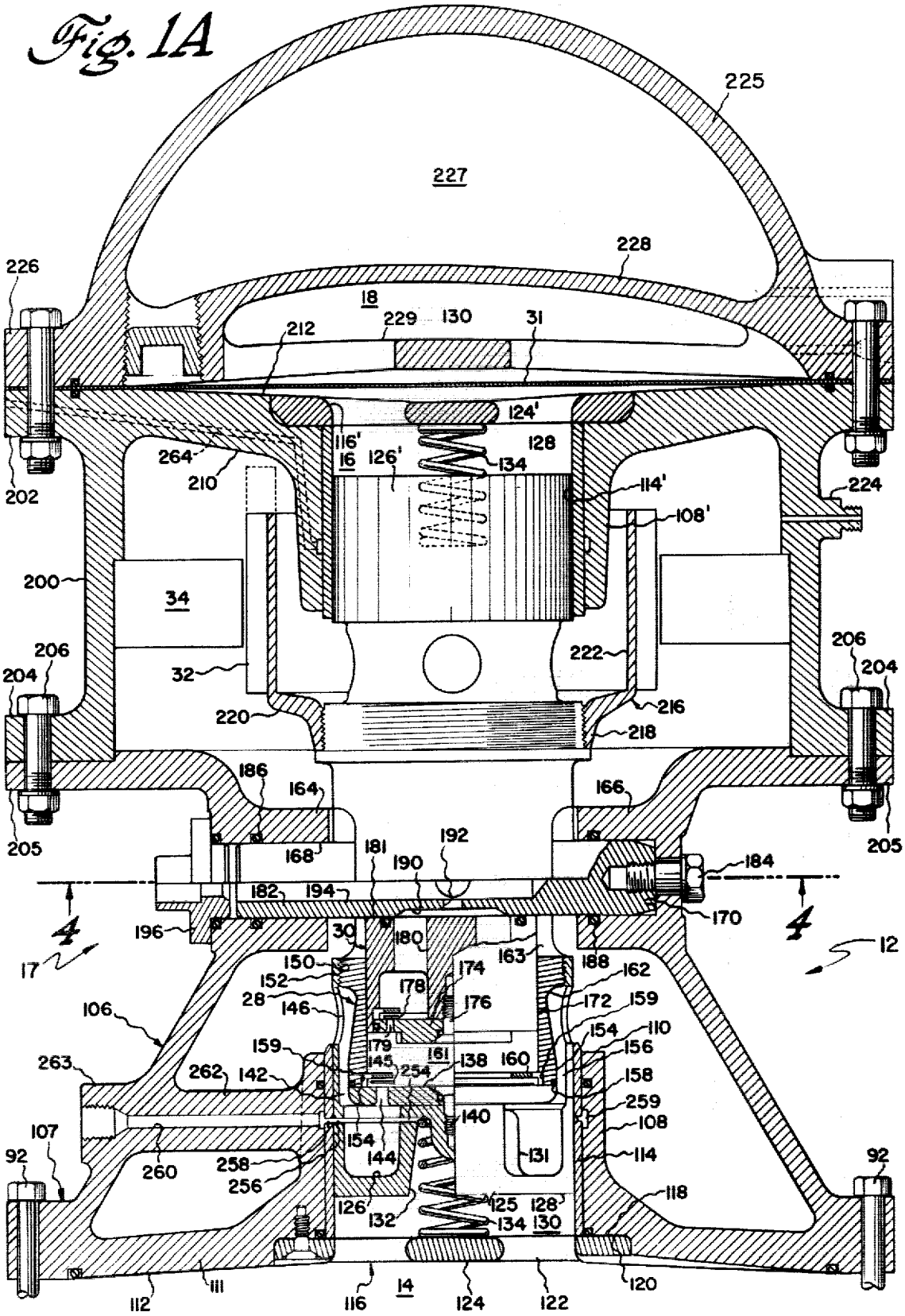
FIGS. 1A and 1B are the top and bottom sections, respectively, of a sectional elevation of a Stirling engine driven alternator/compressor made in accordance with this invention.
Figure 1B:
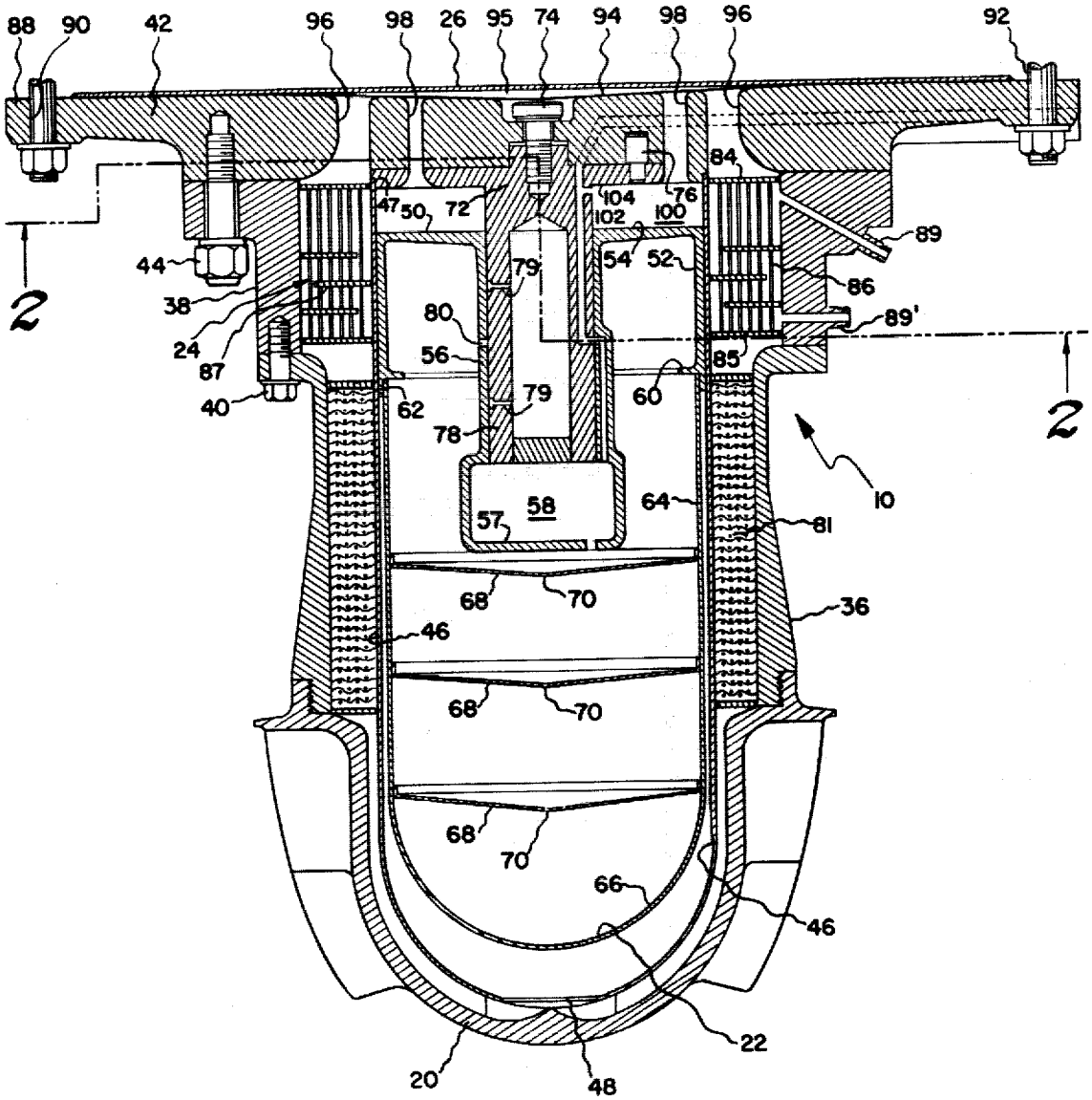
Figure 2:
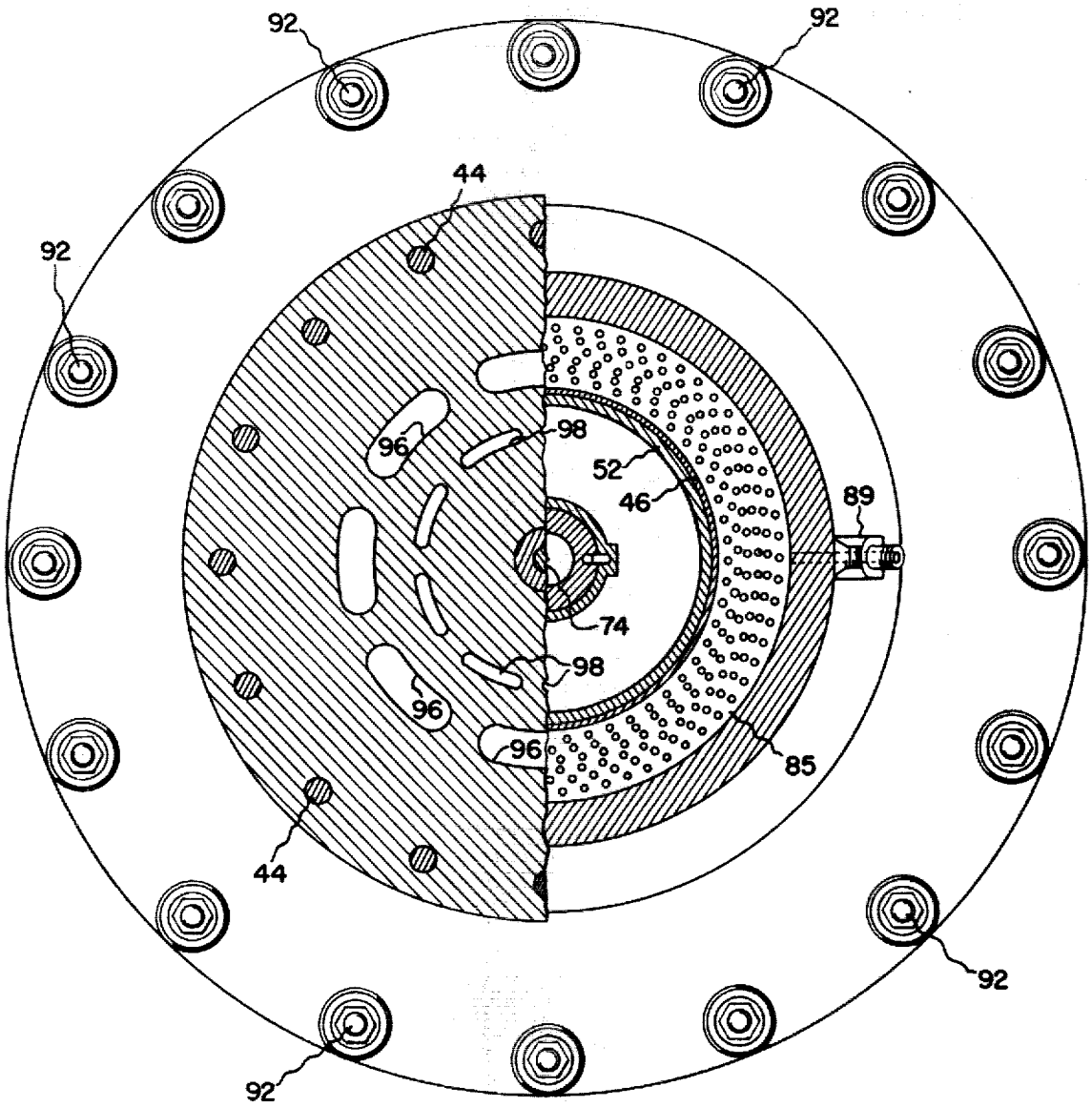
FIG. 2 is a plan view along lines 2—2 in FIG. 1B.

Referring now to the drawings wherein like reference characters designate identical or corresponding parts, and more particularly to FIG. 1 thereof, a Stirling engine powered alternator-compressor is shown having a Stirling engine working section 10 and a power section which includes a compressor-alternator assembly 12. The power section and the working section are coupled through a lower hydraulic chamber 14. The distal end (the top end in FIG. 1A) of the compressor-alternator assembly 12 is coupled through an upper hydraulic chamber 16 to a bounce space 18. The working section 10 and the alternator-compressor are all enclosed within a hermetically sealed vessel 17 having a vertical axis.

Broadly, the energy flow through the system begins with heat input to the heater head 20 of the engine which heats a charge of working gas contained within the working space of the engine working section 10. A displacer 22 moves axially in a reciprocating manner in the working space and causes the working gas to cycle between the hot end defined by the heater head 20 and the opposite end which is kept cold by a cooler 24. The cyclic heating and cooling of the working gas causes a periodic pressure wave which is transmitted through a flexible engine diaphragm 26 to the hydraulic fluid in the hydraulic chamber 14 where it drives a compressor cylinder 28 to compress a gas or vapor such as Freon refrigerant in conjunction with a fixed piston 30. The other end of the compressor cylinder 28, operating in a hydraulic chamber 16, is similar in shape to the first mentioned end of the compressor cylinder operating in the hydraulic chamber 14, and is coupled through the hydraulic fluid in the chamber 16 and a bounce diaphragm 31 to the gas spring bounce space 18. An alternator armature 32 is fastened to the compressor cylinder 28 and oscillates with it opposite a fixed alternator stator 34 to produce electrical output power.

The engine displacer 22 oscillates axially in a working space which is defined by the inner surfaces of the heater head 20, a cylindrical regenerator housing 36 to which the heater head 20 is screwed, a cylindrical cooler housing 38 to which the regenerator housing is attached by bolts 40, a base member 42, and the engine diaphragm 26. A shell 46 is anchored to the base 42 at 47 and extends downwardly therefrom coaxially through the working space. The shell 46 has an axial opening 48 in the lower end thereof for directing the flow of working gas in close proximity to the heater head for the purpose of heating the gas.

The displacer 22 includes a top portion 50 having an outside cylindrical wall 52, a flat radially extending annular roof 54 and coaxial sleeve 56 extending into the middle of the displacer 22. The end of the sleeve 56 is enlarged and closed by an end wall 57 to form a chamber 58. The bottom end of the cylindrical wall 52 terminates in a inwardly extending radial flange 60 and a small axially extending lip 62 to which is fastened the top edge of a cylindrical body 64 having a closed rounded bottom end 66. Three disc-shaped stiffener elements 68 hold the shape of the cylindrical body 64 and act as heat shields. The center of each of the stiffner members 68 is punctured by a small hole 70 for enabling the interior of the displacer to pressurize equally throughout.

The base 42 includes a plinth 72 fastened by an axial screw 74 to the central portion of the base 42 and held against rotation with respect thereto by a locating pin 76. An integral axial post 78 depends from the plinth 72 in snug fitting relation to the sleeve 56. The interior of the axial post 78 is pressurized, by a system which will be described below, and provided with a series of small holes 79 which admit pressurized gas to the interface between the post 78 and the sleeve 56 to act as a gas bearing. A hole 80 is drilled in the sleeve 56 axially midway between the series of holes 79 to act as a gas bearing drain.

The regenerator housing 36 encloses an annular cylindrical regenerator 81 composed of a network of fine high-temperature wires such as Nichrome or Inconel. The wires are arranged in a screen or mesh configuration which presents a minimal impedance to the gas flow through the regenerator while presenting a substantial surface area to the gas to facilitate the heat exchange between the wire and the gas. The connection between the regenerator housing and the heater head 20 and the cooler 24 facilitates easy inspection and replacement of the regenerator should that be necessary.

The cooler 24 includes the cooler housing 38 presenting an annular space between the inner surface of the cooler housing 38 and the outer surface of the shell 46. A cooler assembly is secured in the annular space and sealed therein as by brazing or other secure means to prevent any mixing between the coolant and the engine working fluid. The cooler is an annular assembly having a top plate 84 and a bottom plate 85, both of which are perforated with a multitude of closely spaced small diameter aligned holes. A plurality of fine tubes 86 are brazed at their ends between the top and bottom plates 84 and 85 to provide a gas passage between the plates with a very large heat exchange surface area. A set of three radial baffles 87 is arranged between the top and bottom plates and alternately fastened at outer and inner circumferential edges to the cooler housing 38 and shell 46, respectively, thereby providing a serpentine path for the coolant. An inlet connection 89 and an outlet connection 89' are provided for connection to coolant lines for circulation of a liquid coolant such as water or liquid freon through the cooler and an external heat exchanger (not shown) for effective cooling of the working gas. The baffle arrangement makes maximal use of the coolant by creating high rates of flow around the tubes and a multi-pass, counter-current flow for optimal heat exchange.

The base member 42 includes an outer flange 88 having holes 90 formed therethrough for receiving bolts 92 which fasten the base 42 to the power section 12 of the vessel. The top face of the base 42 is formed in a shallow concavity 94 which, with the engine diaphragm 26, forms a portion 95 of the cold space or engine working gas compression space. The face 94 also serves as a limit surface to prevent excessive downward deflection of the diaphragm 26.

The base member 42 includes a series of passages 96 extending completely through and establishing communication between the cooler and the portion 95 of the compression space. A second set of passages 98 formed through the base 42 at a position radially inward of the passages 96 establishes communication between the portion 95 of the working gas compression space and a second or lower portion 100 of the working gas compression space bounded between the top face 102 of the displacer and the bottom face 104 of the plinth 72.

The diaphragm 26 lies in a plane which is perpendicular to the axis of vessel 17 and approximately coaxial therewith. This has the advantage of great compactness and rugged construction. It is made possible because the displacer drive arrangement is located within the displacer and therefore does not require external driving mechanisms. An additional advantage of this arrangement, as will appear more clearly in the following description, is the compact connection of the power section, directly to the same vessel with the engine. This makes possible a low cost, unitary power module in which all power transmission is within the vessel and the only connections to the vessel are fuel lines and power take-off lines from the compressor and alternator.

Figure 5C:
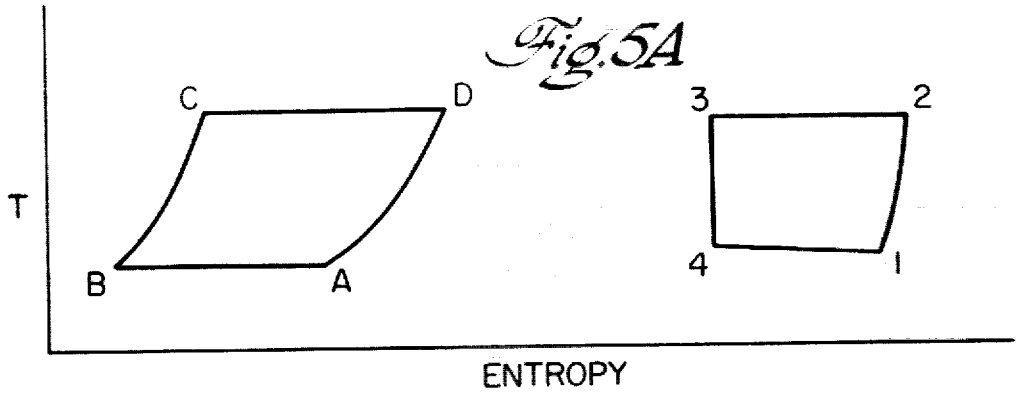
FIG. 5C is a schematic diagram of the Stirling engine and compressor of the embodiment shown in FIG. 1.
Figure 5C:
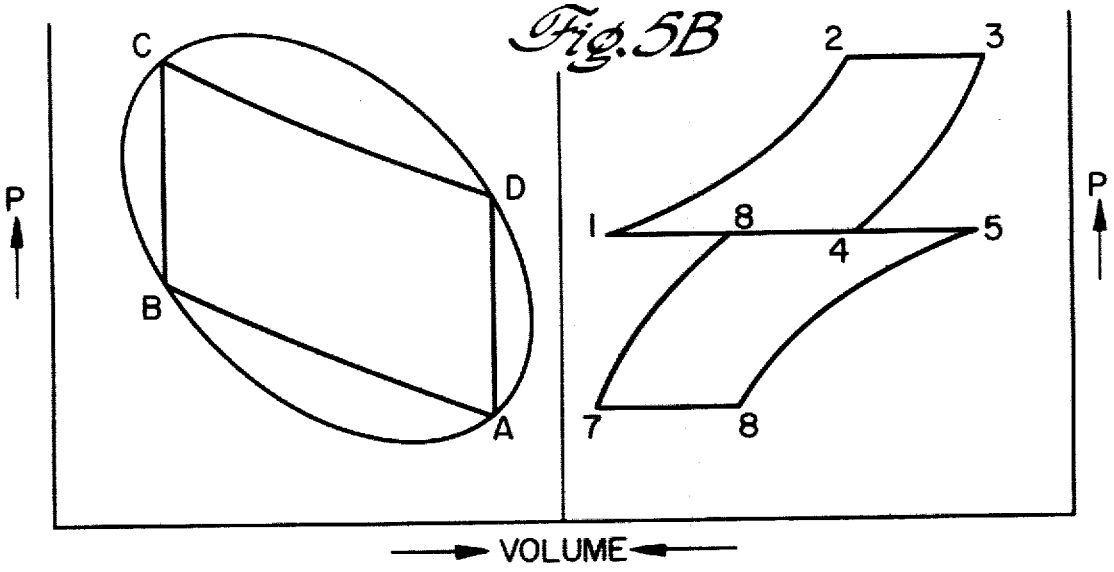
Figure 5C:
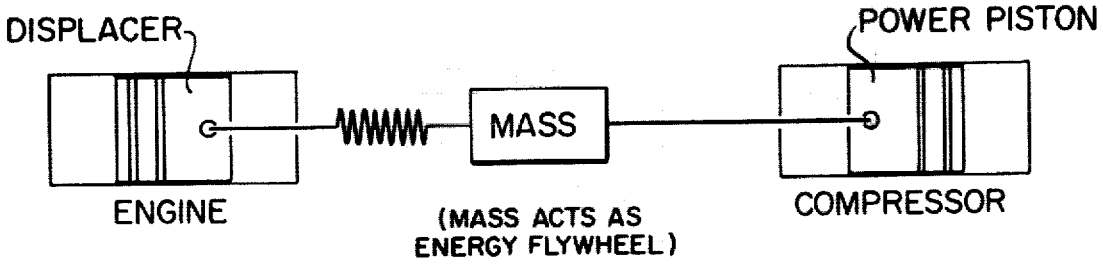

The gas flow path of the Stirling engine will now be described in connection with the theoretical or ideal Stirling engine cycle as shown in the temperature-entropy and pressure-volume diagrams of FIGS. 5A and 5B. At an arbitrarily selected starting point, the displacer 22 is at its lowermost position with the dome-shaped bottom portion of the displacer close to the dome-shaped bottom portion of the shell 46, and the engine diaphragm 26 in its uppermost position away from the top face 94 of the base member 42. In this configuration, the gas volume is maximum and the gas temperature and pressure are minimum. This is point A on the pressure-volume and temperature-entropy diagrams. The process A-B is performed by the diaphragm 26 moving downwardly toward the face 94 of the base member 42. This process is an isothermal compression of the cold working gas wherein the heat occasioned by the compression of the gas is transferred from the gas to the cooler 24. At position B the diaphragm is at its lowermost position against the face 94 of the base 42 and the displacer is at its lowermost position with the rounded end 66 of the displacer 22 close to the rounded bottom end of the shell 46. At this point, the volume, temperature, and entropy are all at their minimum values.

The next motion is the motion of the displacer moving upwardly away from the curved bottom face of the shell 46 toward the bottom face 104 of the plinth 72. This displacer motion causes the gas to be displaced from the cold space at the top end of the engine through the cooler and then through the regenerator where it is reheated by the heat deposited in the regenerator during the last cycle, and then passes between the heater head 20 and the shell 46 where it is heated at constant volume by heat transfer from the heater head 20. When the displacer 22 reaches its uppermost position, the gas, still at minimum volume but now at maximum pressure and temperature, does work on the diaphragm, driving the diaphragm upward in the process C-D which is an isothermal expansion of the working gas where heat is transferred to the working fluid at the maximum cycle temperature of the external source. The displacer again moves downward to displace the hot gas toward the cold zone, during which it passes through the regenerator and deposits its heat into the regenerator where it is cooled at constant volume. This is the process D-A in which the pressure and temperature drop at constant volume. The cycle then repeats itself at the natural frequency of the system. If the heat which is transferred to the working fluid from the regenerator matrix is the same as that transferred from the fluid to the matrix, then only the external heat transfer processes remain; the efficiency is consistent with the Carnot cycle efficiency. The advantage of the Stirling engine cycle is that the two isentropic processes of the Carnot cycle are replaced by two constant volume processes which increases the area under the P-V diagram resulting in higher specific work output levels without resorting to very high pressures and high swept volumes.

The ideal cycle described assumes that the processes are thermodynamically reversible. That is, the expansion and compression processes are isothermal and that infinite heat rates exist in addition to infinite heat capacities. The ideal analysis neglects the effects of regenerator matrix voids, clearance spaces and cylinder pockets. In addition, the displacer and engine diaphragm are assumed to move in a discontinuous manner whereas, in reality, the motion is smooth and continuous. Therefore, the theoretical P-V and T-S diagrams are rounded off as shown in the oval shaped curves. Aerodynamic and mechanical losses are also neglected. Inclusion of these losses of course, results in a lower net cycle output power and lower efficiency. The addition of heater and cooler components changes the real heat transfer to a more adiabatic situation rather than the assumed isothermal processes. Penalties in additional aerodynamic flow losses and increased dead volume result. The use of practical equipment imposes one additional reality; that the fluid is heated not only as it flows to the expansion space, but also as it flows in the reverse direction from the expansion space to the cooler. The cooling process is also penalized in this manner as well. These losses have been minimized by this engine design to maximize the engine efficiency toward the ideal Carnot efficiency.

Turning back again to FIG. 1, the power section will now be described. The hermetic vessel 17 includes a cast aluminum casing 106 having a lower flange 107 to which the outer flange 88 of the base member 42 is bolted by the bolts 92. The casing 106 includes an integral hydraulic cylinder 108 which is coaxial with the vessel axis. The hydraulic cylinder 108 terminates at a top end 110 and flares on its bottom end in a web 111 with a concave face extending outward to the same diameter as the concave face 94 on the base member 42. The bottom face 112 of the casing 106 serves a function corresponding to the concave face 94 of the base 42, namely to prevent excessive deflection of the engine diaphragm 26 and also to provide a wide area over which the engine working gas can act through the engine diaphragm 26 to displace a significant volume of hydraulic fluid to act in the hydraulic cylinder 108.

The hydraulic cylinder 108, which is cast integrally with the case 106 and therefore is of the same material, is lined with a sleeve 114 of high-strength, wear-resistant material such as stainless steel. The sleeve is retained in position by a spider 116 having an outer ring 118 which fits into a recess 120 at the lower end of the hydraulic cylinder 108. The spider also includes a series of arms 122 extending inwardly to a center disc 124.

Figure 3:
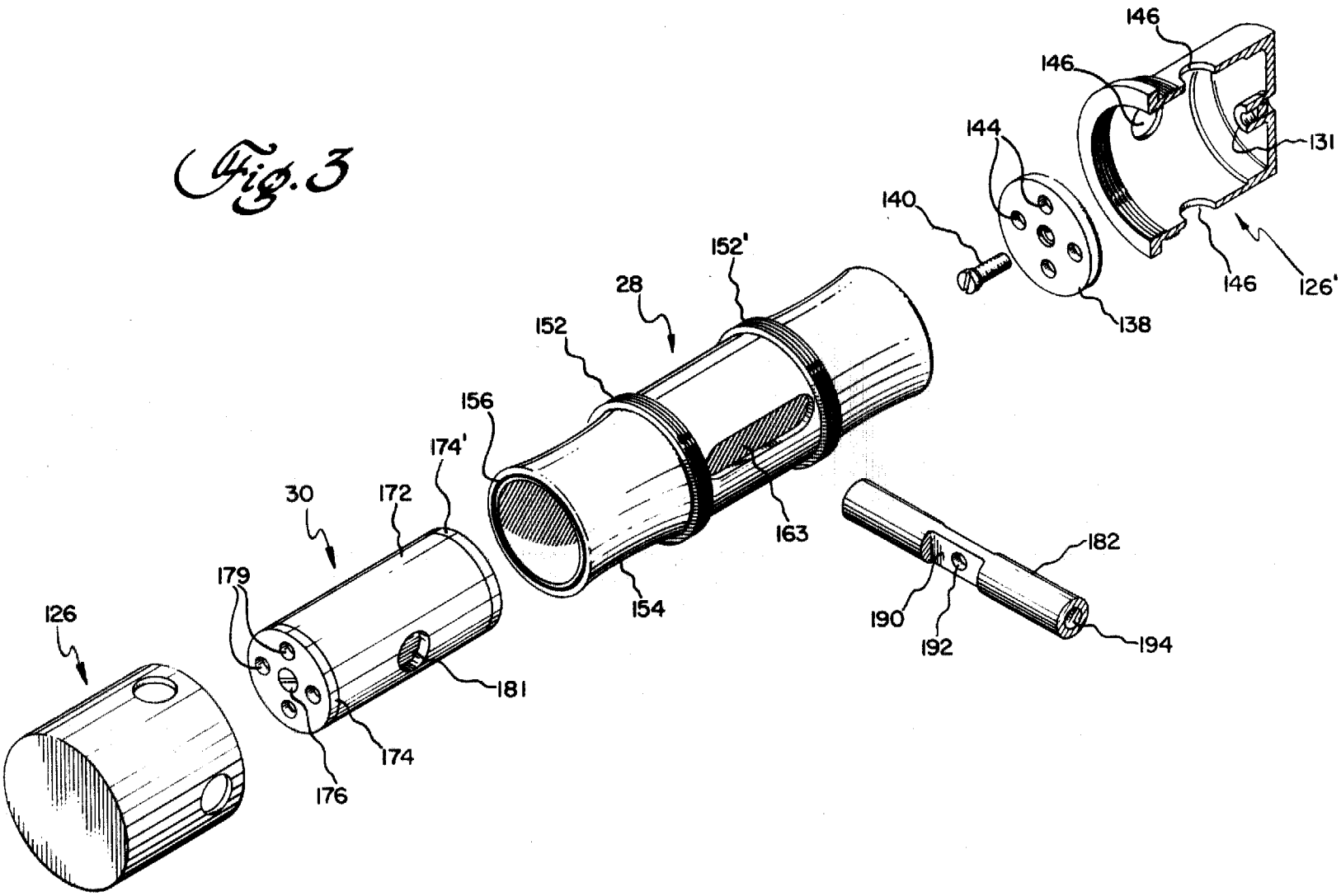
FIG. 3 is an exploded view of portions of the gas compressor piston cylinder assembly shown in FIG. 1A.

A piston assembly 125 shown exploded in FIG. 3 is mounted for axial reciprocation in the vessel 17, and includes a cup-shaped lower end member 126 attached to the cylinder 28 and operating in the hydraulic cylinder 108. The piston lower end member 126 includes a lower working face 128 which, with the top face of the engine diaphragm 26, defines the lower hydraulic chamber 14. The flexing of the diaphragm 26 in response to a pressure wave generated in the working gas in the Stirling engine working space displaces hydraulic fluid upwardly in the hydraulic chamber 130 to drive the piston 126 upwardly in the hydraulic cylinder 108.

The piston assembly 125 is substantially symmetrical about the transverse plane 4—4, except for an elongation of the top piston member 126' to provide a threaded mounting collar for the linear alternator armature, as will be described below. A hydraulic cylinder 108' lined with a sleeve 114' is disposed at the top end of the vessel 17 to receive a cup-shaped top end member 126' of the piston 125. The end face 128' of the top end member 126' of the piston 125, along with the bounce diaphragm 31, defines a top hydraulic chamber 16 which cooperates with a bounce space 18 to balance the piston 125 dynamically so that it will produce two power strokes for each cycle of the engine working space. The following detailed description of the piston assembly 125 lower end will be understood to apply also to the symmetrically identical structure of the top end, therefore the description will not be repeated for the top end.

An axial boss 131 is formed inside the piston end member 126 extending inward, away from the piston face 128. The boss is hollow, defining an axial well 132 opening in the face 128 of the piston. The well 132 receives one end of a centering spring 134 which is biased between the end wall of the well 132 and the top face of the disc 124. A similar centering spring 134' acts in a symmetrically identical well opening in the top end 126' of the piston 125 to exert a centering force on the piston in its cylinders 108 and 108'.

An inlet valve seat disc 138 is fastened to the top end of the central boss 131 by a screw fastener 140 or the like. The diameter of the inlet valve seat disc 138 is smaller than the inner diameter of the piston lower end member 126 to provide an annular passage 142 through which gas to be compressed can flow into the compression space, as will be described below. A series of inlet openings 144, formed in the inlet valve disc, are controlled by an annular valve reed 145 for admitting gas to be compressed and preventing the exodus of gas from the compression chamber as it is compressed, all to be described presently. A series of apertures 146 is formed through the sidewall of the piston lower end member 126 for the purpose of admitting gas to be compressed into the compression chamber.

The top inside periphery of the piston lower end member 126 is internally threaded at 150 and screwed onto a threaded portion 152 of the cylinder 28. The cylinder 28 is threaded to and becomes part of the piston 125, but it functions as a moving cylinder reciprocating on the fixed piston 30. Thus the piston 125-cylinder 28 assembly has both piston and cylinder functions. The cylinder 28 includes a lower end 154 having a diameter identical to the diameter of the inlet valve seat disc 138. An annular groove 156 in the end face of the cylinder 28 receives an O-ring 158 to seal the junction of the cylinder 28 to the inlet valve seat disc 138. The inside lower edge of the cylinder 28 is notched at 159 to receive a stop ring 160 which extends over the inlet valve reed 145 to retain the reed during the suction stroke in which gas flows through the inlet openings, around the reed 145, and into the compression chamber 161. The end of the cylinder 28 is necked down at 162 in the vicinity of the apertures 146 in sidewall of the piston end member 126 to provide the aforementioned annular gas passage 142 for gas passing from the interior of the casing 106 into the compression space. An oval slot 163 extends through both sides of the central section of the cylinder 28 between the threaded portions 152 and 152' to provide clearance for the cylinder 28 to reciprocate around the pipe 182, to be described below.

Figure 4:
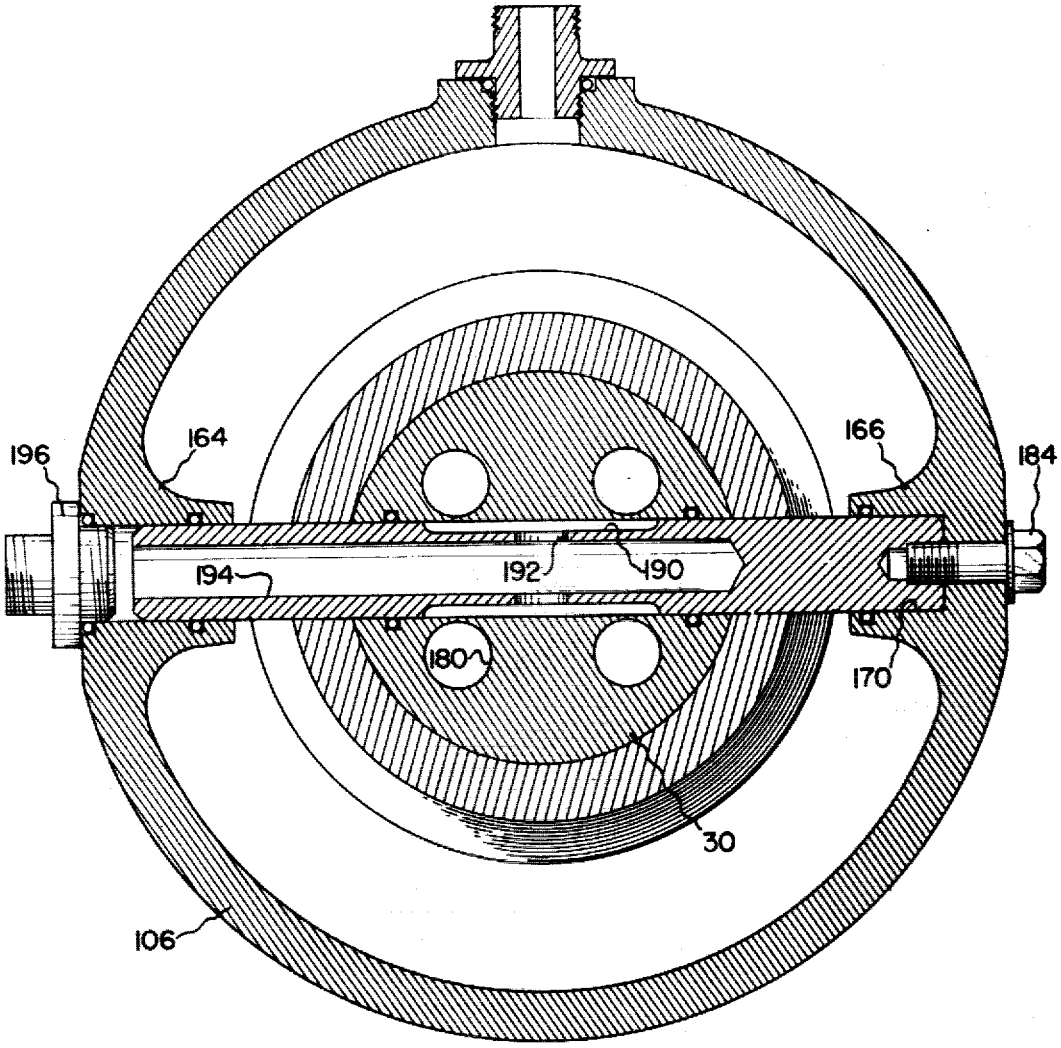
FIG. 4 is a sectional plan view along lines 4—4 in FIG. 1A.

A cylindrical boss 164, best shown in FIG. 4, is formed in the side of the casing 106 at the center of the midstroke position of the piston 125. A corresponding boss 166 is formed in the wall of the casing 106 diametrically opposite the boss 164. A bore 168 extends completely through the boss 164 perpendicular to the vessel axis, and an aligned bore 170 extends partially into the boss 166.

The fixed piston 30 is disposed in the center of the cylinder 28. The fixed piston 30 includes a piston body 172 and an exhaust valve disc 174 screwed to the end of the piston body 172 by a screw 176 or the like. An annular exhaust valve reed 178 lies over a series of openings 179, in the exhaust valve disc 174 for exhausting gas which has been compressed between the inside face of the inlet valve disc 138 and the outside face of the exhaust valve disc 174, which space constitutes the compression space 161 of the gas compressor. In a manner similar to the inlet valve arrangement, the lower end of the piston body 172 is notched to receive a valve stop ring which is held in place in its notch by the outlet valve disc 174. A series of gas channels 180 communicate between a plenum behind the exhaust valve reed 178 and a central transverse bore 181 extending completely through the piston body 172 and of equal diameter to the bore 168 in the boss 164 and the bore 170 in the boss 166.

A pipe 182 extends through the bore 168 in the boss 164, the slots 163 in the cylinder 28, the bore 181 in the piston body 172 and into the bore 170 in the boss 166. A screw 184 is threaded into an internally threaded hole in the end of the pipe 182 to fasten the pipe to the casing 106. An O-ring 186 seals the pipe 182 in the bore 168 of the boss 164 and a corresponding O-ring 188 seals the pipe in the bore 170 of the boss 166. The pipe 182 extends through the central transverse bore 181 in the piston body 172 to secure the piston 30 in place in the casing 106 and to establish fluid communication from the interior of the piston 30 to the exterior of the case 106. This communication is established by a recess 190 which connects the channels 180 in the piston body 172 with an aperture 192 in the pipe 182, which aperture permits gas to flow from the piston interior into the interior 194 of the pipe 182. A fitting 196 is threaded into an internally threaded portion at the end of the boss 164 for connection to external gas lines by which the compressed gas may be piped to its use, as in a heat pump.

The manner of assembly of the compressor apparatus will now be described. The exhaust valve discs 174 and 174' are screwed to the ends of the piston body 172 which is then inserted into the cylinder 28. The inlet valve seat discs 138 and 138' are screwed to the interior top of the central boss 131 on the two piston end portions 126 and 126', respectively, and the two piston end portions 126 are screwed onto the cylinder 28 at the threaded portion 152 The lower end 126 of the piston cylinder assembly is then inserted into the hydraulic cylinder 108 and the pipe 182 is slid through the bore 168, the slots 163 in the central portion of the cylinder 28, the bore 181 in the piston body 172, and into the bore 170. The screw 184 is threaded into the threaded hold in the end of the pipe 182 to secure the assembly into position.

The diaphragms 26 and 31 have a number of functions in the system. One important function is providing a hermetic and thermal separation of the engine and compressor working gases. Any intermixing of the working gases would have a deleterious effect on the performance of the engine or the compressor because of the particular characteristics of the working gases in the thermodynamic cycles they perform. It is desirable, therefore, that there be a "hard" or hermetic separation of the working gases, and this precludes the use of sliding seals. One technique for providing the hermetic separation of working gases in an internal compressor is the spring tube. While this arrangement works well, there is a thermal penalty introduced by the close proximity of the engine working gas to the compressor working gas across a metal interface of large surface area. The engine working gas in the cold compression space is considerably hotter than the compressor working gas at suction pressure, and the transfer of heat through the spring tube to the compressor suction gas imposes an efficiency penalty to the compressor. The design of the invention disclosed herein substantially reduces that heat transfer and thereby improves the efficiency potential of the compressor.

The hydraulic coupling between the diaphragms and the compressor provide an ideal backing for the diaphragms by eliminating stress concentrations and also provide an ideal environment in which the pistons 126 and 126' can operate with low friction and uniform temperature. This hydraulic fluid would cause severe problems if it leaked into the engine, but such leakage is positively prevented by the hermetic sealing of the diaphragms.

This design has two degrees of freedom which is a simple arrangement to control, thereby simplifying the system controls. The controls are described below and will be seen to be uncomplicated, inexpensive and reliable fluid controls. This simplification is made possible by the use of diaphragms which eliminate at least one degree of freedom in the system.

An alternator housing 200 having top and bottom flanges 202 and 204 is secured to the casing 106 by means of bolts 206 which secure the bottom flange 204 to a top flange 205 of the case 106. The housing 200 includes a depending hydraulic cylinder 108' connected to a top web 210 of the housing 200. The top surface 212 of the web 210 is slightly concave to provide a backstop for the bounce space diaphragm 31. An upper end hydraulic chamber 16 is defined between the diaphragm 31, the top surface 212 of the web 210, the interior of the hydraulic cylinder 108', and the top face of the upper piston end member 126'. The function of the hydraulic chamber 16 in conjunction with the bounce space 18 will be described below. Except for the linear alternator armature mounting ring, the top end portion of the piston cylinder assembly is symmetrically identical to the lower end portion.

A linear alternator is mounted in the housing 200 for generating electrical power. The alternator includes an armature 32 fastened to a support cylinder 216 of the upper piston end member 126'. The alternator armature includes a depending internally threaded collar 218 which flares outwardly in a funnel-shaped section 220 and is joined to a cylindrical sleeve 222 which supports the alternator armature 32. The armature stator 34 is fastened to the inside surface of the alternator housing 200 in radial alignment with the transverse midplane of the alternator armature.

A top dome 225 is fastened to the alternator housing 200 by bolts extending through holes in a bottom radial flange 226 and aligned holes in the top flange 202 on the alternator housing. The dome 225 encloses a control space [illegible] which is separated from the bounce space 18 by a partition 228. The bottom face of the dome 225 is slightly concave to provide a backing for the diaphragm 31 and includes a spider 229 which provides a backing for the diaphragm 31 while permitting working gas which fills the bounce space 18 to flow freely between the top face of the diaphragm 31 and the bounce space 18.

In operation, a pressure wave in the engine working space causes the engine diaphragm 26 to deflect upwardly, displacing hydraulic fluid in the hydraulic chamber 14 into the hydraulic cylinder 108 where it drives the piston-cylinder 126/28 upwardly. The valve reed 145 is forced shut against the seat disc 138 and the exhaust valve reed 178 opens to exhaust refrigerant compressed in the compression space 161.

The top end 126' of the piston 125 simultaneously moves upwardly in the hydraulic cylinder 108', displacing hydraulic fluid into the hydraulic chamber 16 and flexing the bounce diaphragm 31 upwardly toward the bounce space 18. The gas compressed in the bounce space acts as a spring, storing energy which is returned to the piston-cylinder 126/28 when it is driven downwardly on the return stroke.

The fastigium of the compressor cycle coincides with the minimum enthalpy of the engine cycle and therefore the coupling between engine and compressor must account for this inherent mismatch. This coupling is accomplished by providing the piston-cylinder assembly 126/28 with a mass which absorbs energy from the hydraulic chamber 14 in the form of inertia ($mv^2$) which is transferred to the gas in the compression chamber 161 and also via the diaphragm 31 to the gas in the bounce space 18.

At the end of the up-stroke, the piston-cylinder 126/28 is momentarily stationary, all its inertial energy having been converted to gas pressure in the compression chamber 161 and the bounce space 18, and electrical energy by the alternator. The energy in the bounce space 18 and some of the energy in the compression space 161 is now returned to the piston-cylinder 126/28 by the expansion of the compressed gas. The piston-cylinder 126/28 moves downwardly, compressing gas in the upper compression chamber 161' and displacing hydraulic fluid in the hydraulic cylinder 108 which flows into the hydraulic chamber 14 and pushes the diaphragm 26 into the upper portion of the working gas compression space. The mass of the moving elements, the spring constants of the gas compression spaces 161 and 161', and the bounce space 18 are selected so that the natural frequency of the power piston system is near the natural frequency of the displacer system. The hydraulic fluid pressure and working gas pressure is adjustable, as explained in detail below, and the gas spring-/damping effect of the compressor is self-regulating, so the systems may be held in correct relationship to each other.

The apparatus disclosed can be used as a heat pump in which refrigerant having a low boiling temperature, such as Freon R22 or the like is compressed by the compressor and the electrical demands of the system such as blowers, pumps, and solenoids can be supplied by the linear alternator. The cold refrigerant enters the case 106 at suction pressure at an inlet fitting 224. It fills the interior of the alternator housing 200, cooling the stator windings 34, and fills the interior of the case 106. From there it can be drawn into the compression chamber at each end of the piston-cylinder assembly where it is compressed and expelled at exhaust pressure through the pipe 182 and the fitting 196 to the external heat exchangers.

Figure 6:
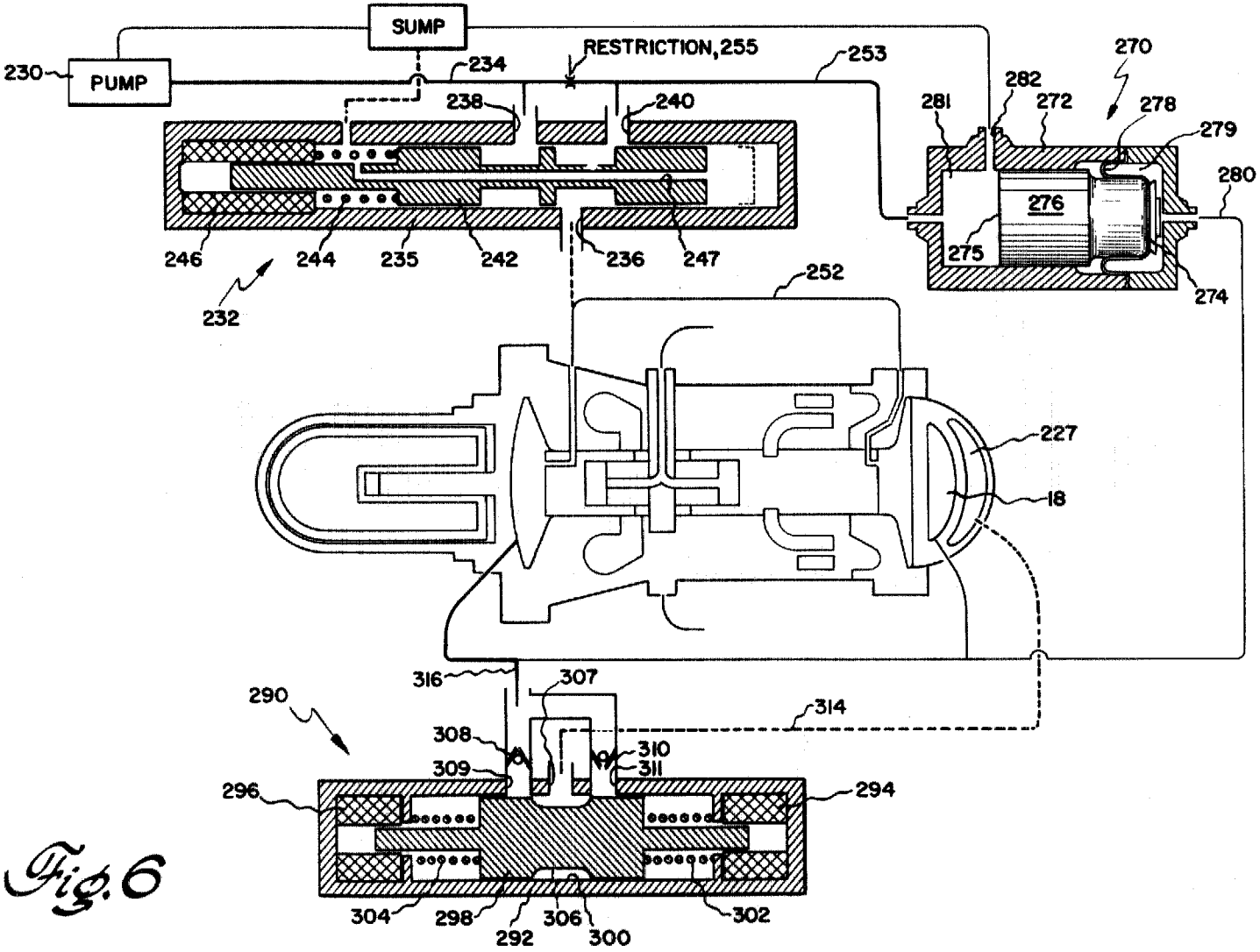
FIG. 6 is a schematic view of the controls for the device shown in FIG. 1.

The control system for starting the engine and controlling the power output is shown in FIG. 6. After a temperature differential is established between the heater head 20 and the cooler 24, it may be necessary to give the displacer an initial movement to initiate working gas circulation and start the engine. That movement is given in the system by pressurizing both hydraulic chambers 14 and 16 to a pressure higher than the mean pressure of the working gas in the engine and in the bounce space 18. This will cause the diaphragms 26 and 31 to flex outwardly away from the hydraulic chambers. The hydraulic pressure can then be released suddenly causing the diaphragms to bounce inwardly toward the gas compressor thereby causing a pressure wave in the working space in the Stirling engine 10 which causes an initial movement of the displacer.

The hydraulic chambers 14 and 16 are pressurized by an oil pump 230 which pressurizes oil in an oil supply line 234 to about 20 psi higher than the mean hydraulic pressure in the hydraulic chambers 14 and 16. The high pressure oil supply line 234 from the oil pump 230 is connected to a starter control 232. The starter control includes a spool valve having a valve body 235 in which is formed a center oil passage 236 and two end passages 238 and 240. The spool valve includes a spool valve element 242 biased in the start position (to the left) by a spring 244 and is moved to the normal running position (to the right) by a solenoid 246. An axial passage 247 running through the valve element 242 enables the element to move in the valve body 235 without pressure cushions developing at its ends.

The operation of the starter control 232 is as follows: The pump 230 is energized to pressurize hydraulic fluid in the line 234. The spring 244 holds the starter control valve element 242 in the start position (to the left in FIG. 6) wherein fluid communication is established between the line 234 connected to the end passage 238 through the interior of the valve body to the center passage 236. The center passage 236 is connected to an oil line 252 which links both hydraulic chambers 14 and 16, whereby the chambers may be pressurized. After the hydraulic chamber pressure has reached the desired magnitude, the solenoid 246 is energized and moves the element 242 against the spring force to the left (to the position illustrated in FIG. 6) establishing fluid communication between the oil line 252, through the center passage 236 and out the end passage 240 to the distal portion 253 of the oil supply line, connected to the high pressure section 234 through a restriction 255, and thence to an oil sump, as will be explained below. This permits the oil pressure in the hydraulic chambers 14 and 16 to drop suddenly causing the diaphragm 26 to flex away from the engine working space and causing a sudden drop in the pressure of the working gas. The gas spring 58 will sense that pressure drop somewhat slower than the displacer top and bottom faces and therefore the displacer will move downwardly in the shell 46, displacing working gas through the regenerator to the cooler, thus starting the working gas circulation and the engine cycle.

The oil line 252 also serves to establish communication between the hydraulic chambers 14 and 16, at the midstroke position of the piston cylinder assembly 126/28 to equalize the pressure in the two chambers. As shown in FIG. 1A, a passage 254 leads from an opening in the well 132 of the piston end sections 126 through a web (not shown) in the piston end member 126 and out through an opening 256 in the wall of the piston end member 126. A corresponding opening 258 in the hydraulic cylinder liner 114 opens to an annular groove 259 in the inside wall of the hydraulic cylinder 108 which in turn leads to an oil passage 260 in a web 262 extending from the hydraulic cylinder 108 and the wall of the case 106. The opening 258 in the cylinder liner 114 is aligned with the opening 256 in the piston wall at the midstroke position of the piston-cylinder assembly, thereby establishing communication through the oil passage 260, through the midstroke balancing line 252 connected to a connector 263 on the wall of the case 106, and through a corresponding passage 264 through the alternator housing 200 to a corresponding midstroke balancing oil passage system in the top piston end member 126'. This passage system permits the oil pressure in the two hydraulic chambers 14 and 16 to equalize at the midstroke position of the piston-cylinder assembly 126/28 to ensure dynamic centering of the midstroke position in the housing, and the alternator armature 32 in the stator 34.

The mean hydraulic fluid pressure in the hydraulic chambers 14 and 16 must be equal to the mean working gas pressure in the compression space in the engine and the bounce space 18 in the top end section 225. To maintain this equality, a pressure control 270 is provided having a body 272 defining therein a cylindrical chamber which houses a cylindrical plunger 276. One end 274 of the plunger 276 is connected to a long roll diaphragm 278 such as a Bellowfram, and the other end 275 controls an oil drain port, as will be explained presently. The Bellowfram separates the chamber into two ends: one end 279 is connected by a capillary gas line 280 to the bounce space 18 to insure that the gas pressure behind the Bellowfram 278 is at the engine working gas mean pressure. The other end 281 of the chamber is connected to the oil line 253 and thence through the restriction 255 to the high pressure oil supply line 234. The restriction 255 normally reduces the hydraulic pressure to about the mean fluid pressure in the engine.

The end 275 of the plunger 276 is disposed near the oil drain port 282 in the wall of the chamber 281 which can be covered and uncovered by the plunger 276. When the pressure of the working gas is higher than the hydraulic pressure, the pressure in the gas end 279 of the pressure control 270 is higher than the pressure in the fluid end 281 and moves the plunger 276 toward the end 281, sealing off the drain port 282. The normally open passage through the start control 232 between the end passage 240 and the center passage 236 permits the pump 230 to raise the pressure of the hydraulic fluid through the restriction 255 in the hydraulic chambers 14 and 16 during the midstroke position of the piston cylinder assembly until the hydraulic and working gas pressures are equal.

When the hydraulic fluid pressure is higher than the mean working gas pressure, the plunger 276 moves toward the gas end 279 of the pressure control 270, uncovering the drain port 282 and permitting hydraulic fluid to bleed out of the fluid end chamber 281. The back pressure is thus relieved and hydraulic fluid can flow from the chambers 14 and 16 through the midstroke pressure balancing line 252, the starter control valve, and the oil line connecting the end passage 240 to the line 253 downstream of the restriction 255, until the hydraulic fluid pressure and the working gas pressure are equalized.

Power modulation is achieved by controlling the pressure of the working gas in the engine. Essentially, the technique for controlling the gas pressure in the working space is to selectively connect the control volume 227 in the top section 225 of the vessel to the working space through a check valve which permits gas to flow in the desired direction during the portion of the cycle in which the space to receive the gas is at a lower pressure than the space from which the gas is supplied. For example, if it is desired to lower the pressure of the working gas in the working space of the engine, a power modulation control 290 will permit gas flow from the working space to the control volume 227 during the high-pressure periods of the engine cycle, but prevent flow of gas in the opposite direction from the control volume.

The power modulation control 290 includes a body 292 having a pressure increase solenoid 294 mounted on one end and a pressure decrease solenoid 296 mounted on the other end. The solenoids 294 and 296 are connected to a control element 298 which slides axially in a bore 300 in the power modulation control body 292. A pair of centering springs 302 and 304 bear against opposite shoulders on the control element 298 to center the element in the bore when the two solenoids are deenergized. The center portion of the control element 298 is relieved at 306 to provide gas flow between a center port 307 and a right port 309 or left port 311 when the control element is displaced to the right or left, respectively, in the bore 300, but prevent gas flow when the element is centered. An inflow check valve 308 and an outflow check valve 310 are provided to permit the flow of gas into and out of the control body 292 depending on the position of the control element 298. The center gas port 307 from the control element body 292 is connected to the control volume by a fluid line 314. The right and left ports 309 and 311 are connected by fluid lines to the working space by a fluid line 316.

In operation, when it is desired to increase the power of the system, the increase solenoid 296 is energized pulling the control element 298 to the left in FIG. 6, thereby establishing fluid communication between the lines 314 and 316 through the check valve 310 and the control body passages to permit fluid flow from the control chamber through the relieved portion 306 in the control element and hence through the fluid line 316 into the bounce space 18 at the working space in the Stirling engine and the engine working space. The fluid flow occurs only during the low-pressure portions of the Stirling engine cycle since the control chamber pressure is lower than the maximum cycle pressure of the gas in the working space. The engine working gas pressure is thus increased which increases the engine power.

When it is desired to decrease the power in the Stirling engine, the decrease solenoid 294 is energized to pull the control element 298 to the right against the force of the spring 304. Communication is established between the inlet check valve 308 and the central gas passage 307 so that fluid can flow from the Stirling engine working space during the high-pressure periods of its cycle through the check valve 308 and the control passage to the central passage 307 and thence through the line 314 into the control chamber 227. The pressure of the working gas in the Stirling engine and the bounce space is thus reduced, and the engine power is reduced.

The system described above provides a Stirling engine powered compressor-alternator which is sealed to prevent the loss of working gases and lubricant, and is provided with positive internal sealed separation of the engine working fluid from the compressor working fluid. The sealing is achieved by diaphragms operating in hydraulic chambers to give an incompressible linkage between the power piston and the diaphragm, without creating a stress concentration zone on the diaphragms. The engine cycle and the compressor cycle are made concordant by the mass and damping of the power piston and linear alternator armature. The system power output and internal pressure balancing is automatically controlled, making possible continuous power modulation in response to external power demand. The internal electrical power requirements are provided by the linear alternator, making the system completely independent of the vulnerable external grid so that a gas fuel source is the only energy requirement.

Obviously, numerous modifications and variations of the above described preferred embodiment are possible in view of this disclosure. It is, therefore, to be expressly understood that these modifications and variations, and the equivalents thereof, may be practiced while remaining within the spirit and scope of the invention which is defined by the following claims, wherein:

I claim:

1. A Stirling engine power unit, comprising:

a vessel adapted to hold a working gas under high pressure in a working space;

an external heater for heating the working gas in a hot space of said vessel, and a cooler for cooling the working gas in a cool space of said vessel;

a displacer movable in said vessel to shuttle the working gas between said hot space and said cool space to produce a periodic pressure wave in the working gas;

a first flexible wall having one face sealing the working gas in said working space and flexing in response to said pressure wave;

a first hydraulic chamber adapted to contain a hydraulic fluid and sealed on one side by the other face of said first flexible wall, so that flexing of said first flexible wall causes displacement of hydraulic fluid in said hydraulic chamber;

a power piston having one end in said first hydraulic chamber and movable in response to displacement of the hydraulic fluid in said hydraulic chamber;

a second hydraulic chamber adapted to contain a hydraulic fluid, bounded on one side by the other end of said power piston, and bounded on the other side by one face of a second flexible wall;

a bounce space adapted to be filled with said working gas, said bounce space bounded on one side by the other face of said second flexible wall and on the other side by an interior surface of said vessel;

a control plenum in said vessel adapted to be filled with said working gas; and means for modulating the power of the engine.

2. The engine defined in claim 1, wherein:

said power modulation control includes a gas flow control connected to said working space and said control plenum for selectively increasing the working gas pressure in said working space for increasing the engine power, and decreasing the working gas pressure in said working space for decreasing the engine power.

3. The engine defined in claim 1, further comprising:

a pressure balance control for maintaining a selected pressure proportion between said hydraulic fluid and said working gas.

4. The engine defined in claim 1, further comprising:

a starter control for producing a starting pressure wave in said working gas to move said displacer and thereby initiate working gas circulation.

5. The engine defined in claim 2, wherein said power modulation control further comprises a gas flow line for connecting said control plenum to said working space, and a pair of check valves which selectively permit working gas to flow through said gas flow line between said control plenum and said working space at high and low portions of said periodic pressure wave in said working space.

6. The engine defined in claim 5, wherein said power modulation control further comprises a solenoid actuated spool valve for selectively connecting said check valves in said gas flow line to select the direction of gas flow in said gas flow line.

7. The engine defined in claim 4, wherein said starter control further comprises:

a hydraulic fluid pump for creating a high-pressure source of hydraulic fluid;

a hydraulic fluid sump at low pressure;

valve means for connecting said first hydraulic chamber through a hydraulic fluid flow path to one of said source and sump to flex said first flexible wall in one direction, and for suddenly connecting said first hydraulic chamber to the other of said source and sump to quickly flex in the other direction to create said starting pressure wave in said working gas.

8. The engine defined in claim 7, where:

said valve means is a spool valve movable axially in a housing to selectively connect said first hydraulic chamber to said source and to said sump, said spool valve being arranged to initially connect said first hydraulic chamber to said high-pressure source, and then, in the starting and running configuration, connect said first hydraulic chamber to said sump.

9. The engine defined in claim 7, wherein said hydraulic fluid flow path includes a center port system for establishing fluid flow when said power piston is at the center position thereof, and for cutting off said fluid flow at all other positions of said power piston.

10. The engine defined in claim 3, wherein said pressure balance includes: a housing defining a chamber; a piston movable in said chamber; a hydraulic space at one end of said chamber adapted to receive hydraulic fluid under the mean hydraulic pressure in the engine to move said piston in one direction in said chamber; a gas space at the other end of said chamber adapted to receive working gas under the mean working gas pressure in the engine to move said piston in the other direction in said chamber; an inlet port in said gas space and a gas line connected between said inlet port and said working space to pressurize said working space with working gas at mean engine working gas pressure; an inlet hydraulic fluid port in said hydraulic fluid space and an outlet port in said hydraulic fluid space adapted to be covered and uncovered by said piston when the force exerted on said piston in said one direction is greater and less than the force exerted on said piston in the other direction, respectively; inlet and outlet fluid lines connected, respectively, to said hydraulic chambers at the midstroke position of said power piston, and to a hydraulic fluid sump, respectively.

* * * * *